United States Patent [19]

Sutherland et al.

[11] Patent Number: 5,060,723

[45] Date of Patent: Oct. 29, 1991

[54] WELLHEAD ISOLATION TOOL NIPPLE

[76] Inventors: James M. Sutherland, R.R. #4, Red Deer, Alberta, Canada, T4N 5E4; Kenneth Wenger, R.R. #1, Red Deer, Alberta, Canada, T4N 5E1

[21] Appl. No.: 567,813

[22] Filed: Aug. 15, 1990

[30] Foreign Application Priority Data

Aug. 16, 1989 [CA] Canada ..... 608528

[51] Int. Cl.[5] ..... E21B 23/06; E21B 33/126

[52] U.S. Cl. ..... 166/202; 166/77; 166/387

[58] Field of Search ..... 166/202, 387, 386, 187, 166/101, 72, 77, 80, 82

[56] References Cited

U.S. PATENT DOCUMENTS

| | | | |
|---|---|---|---|
| 2,606,618 | 8/1952 | Page | 166/202 X |
| 2,767,795 | 10/1956 | Bush | 166/202 X |
| 2,927,642 | 8/1955 | Meredith, Jr. et al. | 166/75.1 |
| 2,927,643 | 3/1960 | Dellinger | 166/75.1 |
| 3,100,015 | 8/1963 | Regan . | |
| 3,215,203 | 11/1965 | Sizer | 166/77 |
| 3,566,962 | 3/1971 | Pease, Jr. et al. | 166/202 X |
| 3,830,304 | 8/1974 | Cummins | 166/305.1 |
| 4,162,704 | 7/1979 | Gunther | 166/77.5 |
| 4,632,183 | 12/1986 | McLeod | 166/77 |
| 4,657,075 | 4/1987 | McLeod | 166/72 |

FOREIGN PATENT DOCUMENTS

| | | | |
|---|---|---|---|
| 1094945 | 2/1981 | Canada . | |
| 1169766 | 6/1984 | Canada . | |
| 1217128 | 1/1987 | Canada . | |
| 1222204 | 5/1987 | Canada . | |
| 258979 | 4/1970 | U.S.S.R. | 166/202 |

*Primary Examiner*—Stephen J. Novosad

*Attorney, Agent, or Firm*—Stevens, Davis, Miller & Mosher

[57] ABSTRACT

A wellhead servicing tool is disclosed which comprises an axially shiftable cup which, in one position, virtually entirely surrounds the seal of the tool to facilitate its insertion into the casing of the wellhead. In another extreme position, the cup is shifted away from the seal releasing the latter into sealing engagement with the casing. A telescoping assembly extensible over the main tube of the device reinforces the tube prior to and during the securement to the casing to be serviced thus further facilitating the insertion of the tool into the casing of the services wellhead.

21 Claims, 3 Drawing Sheets

WELLHEAD ISOLATION TOOL NIPPLE

The present invention relates to wellhead isolation tools and particular to improvements thereof directed to facilitate the inserting of the tool in the respective wellhead casing.

The term "wellhead isolating tool" is to be interpreted broadly as referring to a tool the main purpose of which is to insert into an existing casing of a wellhead a co-axial tube or pipe which may be required for different purposes. Such tube, sometimes also referred to as "main tube" is usually provided, at its normally lower end, with a seal. The purpose of the seal is to provide a sealing engagement between the main tube and the casing. It is important that such seal be capable of withstanding, in good operative condition, high pressures prevailing at the wellhead and often generated by the isolation tool.

As an example, it is sometimes necessary in a day to day service to stimulate th®well by means of a high pressure frac. Fluid mixed with sand or the like is pumped down the well at pressures that are often higher than the wellhead equipment is rated for. The present invention relates, in its commercial application, particularly, but not exclusively, to the type of wellhead isolation tool used for this purpose.

In a typical wellhead isolation tool, a high-pressure main tube or mandrel is used and has lessened the danger of the operation. There are many points in the design of such mandrel which still require improvements despite the fact that the known mandrels have been commercially successful.

For one thing, the mandrel and associated high-pressure valve must be guided straight down into the well tree which is usually done through some sort of cradle. Additionally, hydraulic means are usually necessary to force the high pressure mandrel down through the open valves of the well tree. The hydraulic means and the cradle together form a very heavy, cumbersome piece of equipment which frequently takes up so much space that the high-pressure valve at the end of the mandrel must be very far from the ground, where it cannot be reached easily for emergency.

While wellhead valves and fittings have tightly controlled inside diameters, wellhead casings have much loser tolerances. Accordingly, it can happen that a packoff nipple including the seal will fit through the wellhead assembly but will be of insufficient diameter to seal tightly against the inner wall of the well casing. Conversely, the packing may fit tightly against the casing wall but may be too large and thus susceptible to damage while being forced through the wellhead assembly. This may be caused by many reasons which include oval instead of circular inner surface of the casing, corroded or washed casing etc.

Prior art tools in question are exemplified by Canadian Patent No. 1,217,128 (McLeod) entitled WELLHEAD ISOLATION TOOL, issued Jan. 27, 1987, Canadian Patent No. 1,094,945 (Bullen), entitled WELL TREE SAVER, issued Feb. 3, 1981, Canadian Patent 1,169,766 (McLeod), entitled NIPPLE INSERT,issued June 26, 1984.

It is an object of the present invention to further advance the art of the above tools by providing an arrangement which facilitates the inserting of the isolation tool into a wellhead casing while avoiding or at least reducing the problems mentioned above.

In general terms, the present invention provides a seal apparatus for use in a well servicing tool, to facilitate the inserting of the tool into a wellhead casing, said apparatus comprising, in combination:

(a) a seal tube having a normally upper first end portion, a normally lower second end portion, securement means for securing the first end portion to a normally lower end of an associated main tube of the respective well servicing tool;

(b) annular seal including an outwardly oblique first skirt-like sealing portion divergent in a normally downward, first axial direction toward a free end of the apparatus, said sealing portion having a free end portion defining a sealing lip complementary with the inside diameter of an associated wellhead casing, said seal being sealingly secured to said seal tube;

(c) seal protective cup being disposed in proximity to the seal and adapted to receive the sealing lip in a radially inwardly compressed state;

(d) cup displacement means adapted to provide selective axial displacement between the cup and the seal along the axis of said seal from a first position, in which the cup receives and covers the sealing lip in the radially inwardly compressed state, to a second position, in which the cup is spaced from the sealing lip allowing the latter to into engagement with said associated wellhead casing.

The cup preferably moves, relative to the seal, in the first axial direction. In the described embodiment, this is achieved by making the seal slidable along a seal tube, while the cup itself is fixedly secured to the tube. The seal preferably includes an inwardly directed second lip which forms, with the first mentioned lip, a V-shaped groove open downwardly and exposed to pressure, when the seal is operative. In one embodiment, the release of the seal from the cup is caused by the pressure acting at the groove. In another embodiment, the dissociation of the cup and seal is caused by mechanical means. It preferred but not absolutely necessary that the outside surface of the cup be provided with a seal engaging at least partly the surrounding inside wall oaf the casing to increase the pressure which is active at the V-shaped groove. This is aided by passage means in the face of the cup.

The invention will now be described in greater detail by way of two alternative preferred embodiments utilizing different means for operation of the gist of the invention. These will now be described with reference to the accompanying drawings, wherein.

Figure 1:
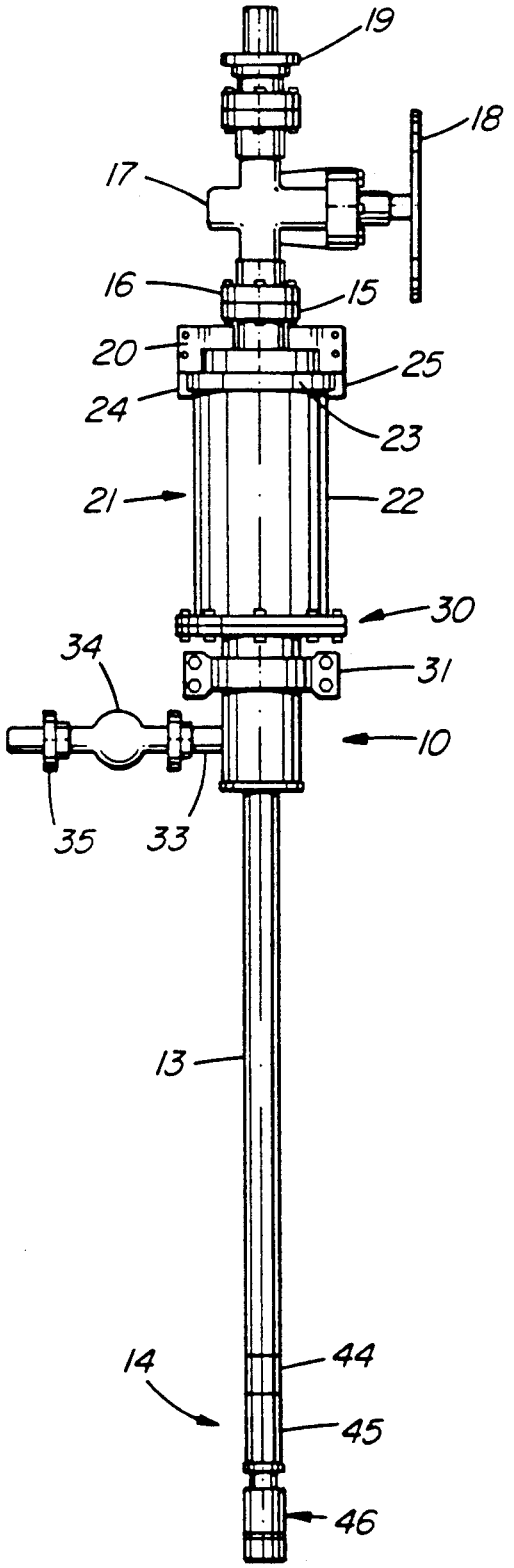
FIG. 1 is a simplified, diagrammatic representation of the overall arrangement of an embodiment of the present invention.

Referring now to the drawings, reference numeral I0 designates a wellhead isolation tool the purpose of which is to introduce under high pressure fluid mixed with sand or the like substance into an existing wellhead casing 11 disposed in the ground 12.

The tool 10 comprises, as its principal part, a hollow cylinder rod or main tube 13 (FIGS. 1 and 4) which is vertical in its operative position and thus has a normally lower end portion 14 and an upper end portion which is not visible in the drawings.

The upper end portion is located approximately at the level of a connecting flange 15 complementary with a flange at the lower end 16 of a valve housing 17. The valve element of the housing 17 is actuated by a handwheel 18 as is well known. The top end of the valve housing 17 is provided with a known hammer union 19 serving the purpose of connecting the housing 17 and thus the main tube 13 to a source of pressurized substance used in s®rvicing the well. The source of pressurized substance is not shown.

The connecting flange 15 is integral with a transverse base 20 forming a part of the upper end of a hydraulic telescopic mechanism 21 which will now be described in greater detail.

Figure 2:
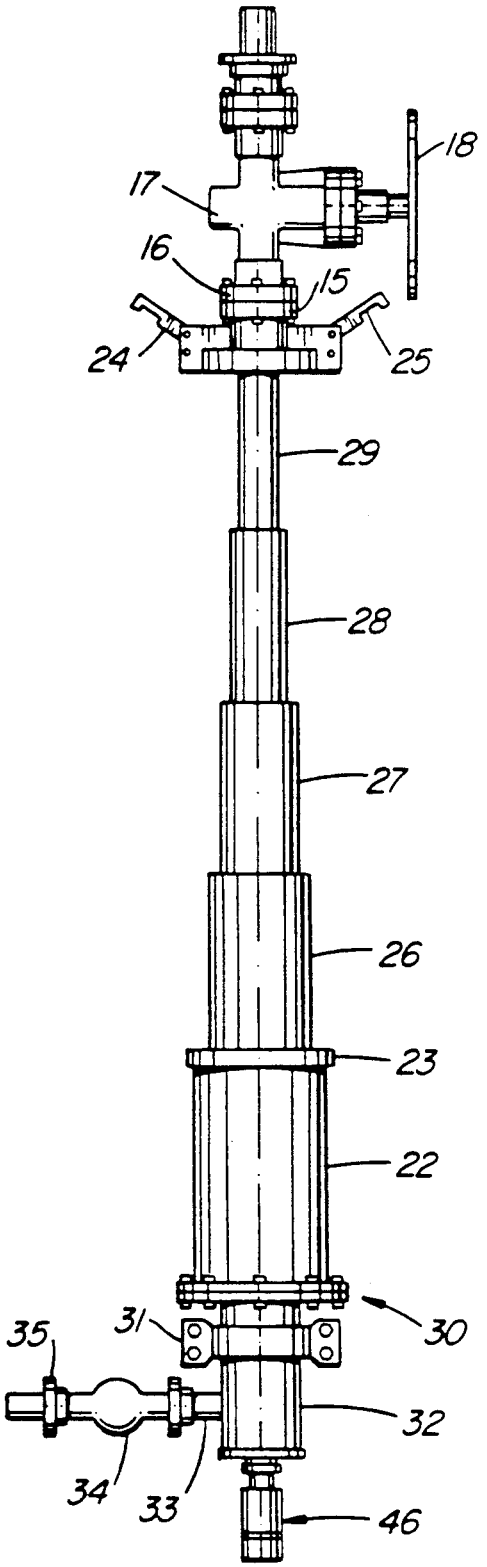
FIG. 2 is a view similar to that of FIG. 1 but showing the extension of telescopic means over the main tube of the tool in preparation for inserting the main tube with the nipple at its lowermost tip, into a wellhead casing and through the associated valves and fittings.

The telescoping mechanism 21 includes a hydraulic cylinder provided at its upper end with a peripheral ledge 23 compatible with two or more lock clamps 24, 25 pivotally secured to the base 20 for pivoting about transverse axes (cf. FIG. 1 and FIG. 2). The clamps 24, 25 thus releasably secure the cylinder 22 to the valve housing 17. Disposed within the hydraulic cylinder 22 is a plurality of intermediate telescopic members 26, 27, 28 and 29 which are slidably and sealingly received within each other for selectively assuming an extended position shown in FIG. 2 and a contracted position of FIG. 1. The lower end 30 of the cylinder 22 is slidable and sealed with respect to the main tube 13.

The lower end 30 is connected by a connecting clamp 31 to a T-valve housing 32 having a branch 33 provided with a relief valve 34 and a hammer union 35 for connection to a conduit not shown in the drawings. The valve 34 is in communication with an annular chamber 36 between the housing 32 and the main tube 13. The annular space 36, in turn, may communicate with an annular space between the main tube 13 and the casing 11, as will be explained later.

Figure 3:
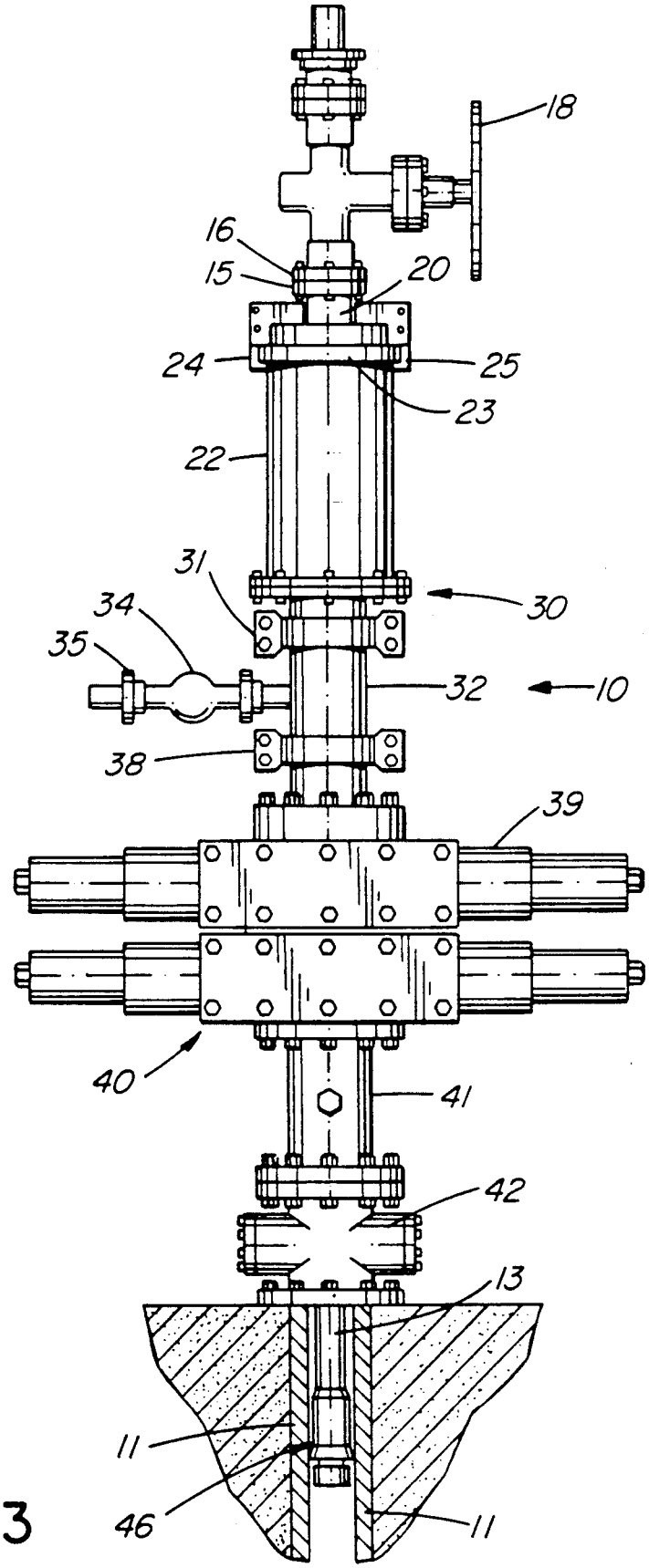
FIG. 3 is a view similar to that of the preceding two figures but showing the nipple and the associated part of the main pipe in place within a wellhead casing.

The lowermost part of the housing 32 is provided with a peripheral mounting ledge or rib 37 compatible with another clamp 38 shown only in FIG. 3 and connecting the housing 32 (and thus the entire described assembly) to a utility such as a series of wellhead blowout preventers 39, 40 secured to the top of the casing 11 by suitable connecting members 41, 42.

The normally lower, free end portion 14 of the main tube 13 is connected, via a bushing 44 with an extension 45 which carries a seal assembly 46.

It will become apparent from the following description that the bushing 44 and the extension 45 are mere production elements forming another part of the main tube 13. Therefore, in the following description of the representation of FIG. 4, reference is made only to the "main tube 13" for the sake of clarity. For the same reason, the reference numeral 13 designating the main tube is used with the numeral 45 in parentheses to indicate that it is the extension of the tube 13 which is actually shown in FIG. 4.

Figure 4:
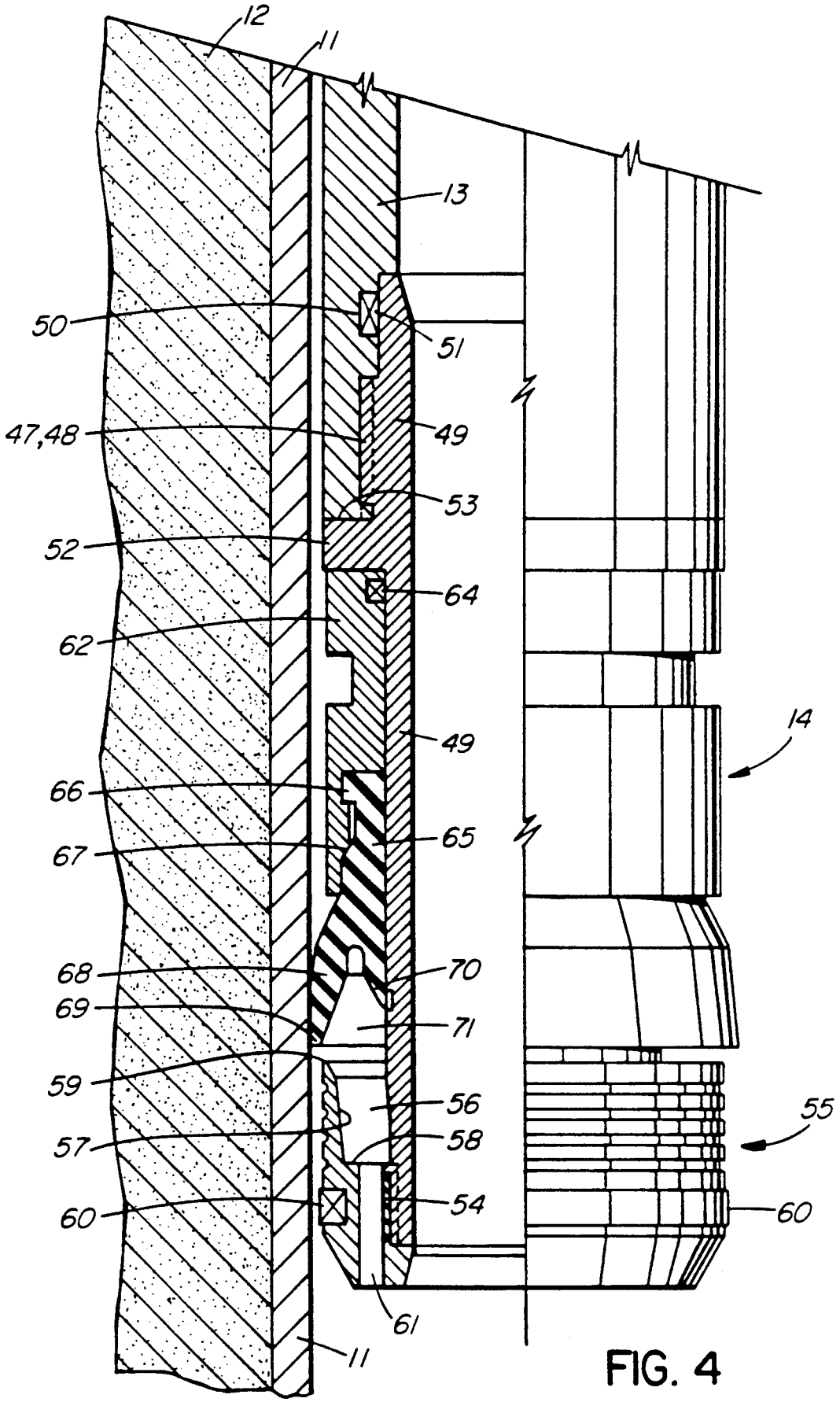
FIG. 4 is an enlarged, partly sectional view of the lowermost end of the tool as shown in FIG. 3 with the representation of the casing removed.

FIG. 4 shows that the lower end of the main tube 13 is provided with inner thread 47 compatible with the outer thread 48 of a seal tube 49. Disposed just above the threaded part 47 of the main tube 13 is an inwardly open groove 50 holding an O-ring seal 51 engaging the outer surface of the seal tube 49.

Spaced below the threaded portion 48 is a radially outwardly protruding shoulder 52. The upper surface of the shoulder 52 is in abutment against the lowermost end face 53 of the main tube 13.

The normally lower end of the seal tube 49 is also threaded at 54 to provide a fixed securement to the seal tube 49 of a seal protective cup 55. The cup 55 defines an upwardly open annular chamber 56 whose inside diameter is formed by the outside surface of the lower end of the seal tube 49. The outer wall 57 of the annular chamber 56 limits the width of the chamber while its bottom 58 is spaced from an upper rim 59 to define a predetermined depth of the chamber 56 in order to render the chamber 56 and thus the cup 55 capable of receiving therein virtually the entire seal of the tool which will be described in detail shortly, and to protect its sealing lip which will also be referred to hereinafter.

The outer surface of the cup 55 is provided with an O-ring seal 60 which reduces the clearance between the cup 55 and the wellhead casing 11 to a minimum. The arrangement of the seal 60 with respect to the casing 11 is such as to secure that the crosssectional area of the clearance between the O-ring 60 and the casing 11 is at all times substantially smaller than the crosssectional area of the combined passages such as passage 61 which communicates the outside of the cup 55 with the interior of the chamber 56 for reasons which will become apparent as the description proceeds.

The part of the seal tube 49 below the shoulder 52 is provided with a sliding, annular seal holder 62. The holder 62 is shown in its uppermost position, limited by the abutting against the lower face 63 of the shoulder 52. A sealing O-ring 64 travels with the holder 62 to provide a sealing arrangement with the seal tube 49.

The lower portion of the holder 62 is recessed to correspond to the shape and size of the upper portion forming a root section of an annular seal 65. At the upper extreme, the seal 65 is provided with an outwardly directed ledge 66 which is of rectangular cross-section compatible with the rectangular cross-section of the corresponding recess in the lower part of the holder 62. This configuration assures that the holder and the seal can slide along the seal tube 49 while at the same time a bevelled section 67 of the holder engages the outside of the seal 65 to keep same in sealing contact with the outer surface of the seal tube 49.

The lowermost part of the seal 65 defines an outwardly oblique first skirt-like sealing portion 68 whose free end forms a sealing lip 69 complementary with the inside diameter of the casing 11. The skirt-like sealing portion combines with a second, inwardly directed skirt portion 70 to form therewith a generally V-shaped groove 71. The groove 71 widens downwardly, i.e. in the same direction in which the first skirt-like sealing portion is divergent. It is also generally referred to as a "first axial direction". That direction is opposite to the direction of the relative movement of the seal 65 from the cup 55 as will be described hereinafter.

Reference may now be had back to the item of the annular chamber 56, its depth and its width. The size of the chamber is such that the chamber is capable of accommodating virtually the entire annular seal 65. The term "virtually entire", of course, designates that part of the seal 65 which is not covered by the holder 62 as the holder covered part is protected by the holder itself at all times.

Thus, on a radially inwardly directed compression of the first skirt-like sealing portion 68, (e.g. by a clamp not shown) the skirt portion 68 can be placed into the annular chamber 56 with the lip 69 closely spaced or abutting against the bottom 58 of the chamber 56 and thus protected against damage during the inserting of the tool into a wellhead as all impacts are taken up by the rigid cup 55. The skirt 68 is kept in the annular chamber 56 by gravity. The size and weight of the seal and of the holder 62 is substantial enough to hold the seal 65 down in the cup 55 during the inserting operation.

In operation, with the valves 17 and 34 closed, the seal 65 is first brought into the cup 55. This situation is diagrammatically shown in FIG. 1, wherein the seal assembly 46 is at a state in which the cup 55 surrounds at least the lip 69 and a substantial portion of the skirt 68. The entire device is suspended from a rig associated with the particular well.

Next the clamps 24, 25 are released and the telescopic assembly 22, 26, 27, 28, 29 extended down as shown in FIG. 2. Thus, the main tube 13 is now virtually entirely covered with and reinforced by the telescopic assembly.

The rig is now manipulated to bring the reinforced main tube 13 into a co-axial arrangement with the upper end of the blowout preventer 39, the cap 55 and the adjacent parts inserted into same and the clamp 38 is then tightened to fix the tool to the preventer 39.

The hydraulic telescopic assembly 22, 26-29 is now contracted again. Since the clamp 38 now holds the cylinder 22 to the blowout preventer, the contracting of the telescoping assembly results in gradual inserting of the seal assembly 46 and the entire main tube 13 first into the blowout preventers and then into the casing 11 itself. The final position is apparent from FIG. 3.

The device is now ready for injection into the casing of the fluid mixed with sand or the like substance required for servicing the well. The upper portion of the apparatus, at the hammer union 19, is connected to a suitable source of the pressurized substance and the valve 17 open. The substance now flows under pressure, which is substantially in excess of the instant well pressure, down the main tube 13. As soon as the back pressure at the cup 55 reaches a value which tends to force the servicing liquid by the O-ring 60, into the annular space between the main tube 13 and the casing 11, the pressurized liquid flows through the passages such as passage 61 into the annular chamber 56, immediately causing upward sliding of the seal 65 against the force of gravity. Eventually, the lip 69 passes past the rim 59 allowing the skirt 68 to expand and to bring the lip 69 into sealing contact with the casing. The full sealing capacity is achieved when the holder 62 engages the underside 63 of the shoulder 52 as the back pressure now acts solely at the annular seal 65 expanding not only the outer skirt 68 but also forcing the second skirt portion 70 into ever tighter contact with the seal tube 49 thus effectively preventing the pressurized liquid from reaching the annular space between the main tube 13 and the casing 11.

When the servicing is completed, the tool is withdrawn through the blowout preventers as is well known in the art.

Those skilled in the art will readily appreciate that the above description relates to an embodiment which can be modified to a greater or lesser degree while still staying within the gist of the present invention. As an example only, the release of the annular seal from the cup, the configuration of the cup the way the relative movement of the seal and of the cup is achieved are all capable of modifications without departing from the present invention.

Accordingly, we wish to protect by letters patent which may issue on this application all such embodiments as properly fall within the scope of our contribution to the art.

I claim:

1. A seal apparatus for use in a well servicing tool, to facilitate the inserting of the tool into a wellhead casing, said apparatus Comprising, in combination:

(a) a seal tube having a normally upper, first end portion, a normally lower, second end portion, and securement means for securing the first end portion to a normally lower end of an associated main tube of the respective well servicing tool;

(b) annular seal including an outwardly oblique first skirtlike sealing portion divergent in a normally downward, first axial direction toward a free end of the apparatus, said sealing portion having a free end portion defining a sealing lip complementary with the inside diameter of an associated wellhead casing, said seal being sealingly secured to said seal tube;

(c) seal protective cup disposed in proximity to the seal and adapted to receive and protect the sealing lip when the latter is in a radially inwardly compressed state,;

(d) cup displacement means adapted to provide selective axial displacement between the cup and the seal along the axis of said seal from a first position, in which the cup receives and covers the sealing lip in the radially inwardly compressed state, to a second position, in which the cup is axially spaced from the sealing lip allowing the latter to expand into engagement with said associated wellhead casing.

2. Apparatus according to claim 1, wherein the relative displacement between the cup and the seal, from the first position to the second position is in said first axial direction, whereby the movement of the lip relative to the cup is in the direction of convergence of said skirt.

3. Apparatus according to claim 2, wherein the cup defines an annular chamber complementary with the seal for virtually entirely surrounding the seal within said annular chamber such that the seal is protected by said cup both at a peripheral portion thereof and at a forward face complementary with the lip.

4. Apparatus as claimed in claim 3, wherein the cup is fixedly secured to the seal tube and wherein the seal is slidable along an outer surface of the seal tube, to bring the lip out of said cup to release the seal into its operative position.

5. Apparatus as claimed in claim 4, wherein the seal includes a root section which is axially opposite to the lip and is surrounded by a seal holding sleeve surrounding the root section and pressing same against the exterior of the seal tube to maintain a sealing engagement between the exterior and the root section.

6. Apparatus as claimed in claim 5, wherein said seal further includes a second, inwardly directed skirt portion combining with the first skirt like portion to form a generally V-shaped groove widening and open in said first axial direction.

7. Apparatus as claimed in claim 3 or 6, wherein said displacement means includes passage means in said cup directed to communicate said annular chamber with a leading end of the apparatus, whereby pressure generated exteriorly of the servicing tool can be communicated to the annular chamber to cause said axial displacement between the seal and the chamber.

8. Apparatus as claimed in claim 7, wherein the cup has a generally cylindrical outside portion whose diameter is smaller than the inside diameter of the wellhead casing but is sufficiently large to provide a smaller cross-sectional area of a clearance between the cup and the associated wellhead casing than that of said passage means.

9. Apparatus as claimed in claim 8, wherein the outside portion of the cup is provided with a seal adapted to sealingly engage the respective wellhead casing, whereby said clearance is reduced to a minimum.

10. Apparatus for inserting main tube means of a well servicing tool into a wellhead casing, comprising in combination, a main tube for conducting servicing liquid substance into a well; inserting means for inserting the main tube into a wellhead casing in coaxial arrangement therewith, and a seal assembly; said seal assembly including (a) a seal tube having a normally upper first end portion, a normally lower second end portion, securement means securing the first end portion to a normally lower end of the main tube;

(b) annular seal including an outwardly oblique first skirtlike sealing portion divergent in a normally downward, first axial direction t oward a free end of the apparatus, said sealing portion having a free end portion defining a sealing lip complementary with the inside diameter of an associated wellhead casing, said seal being sealingly secured to said seal tube;

(c) seal protective cup being disposed in proximity to the seal and adapted to receive the sealing lip in a radially inwardly compressed state;

(d) cup displacement means adapted to provide selective axial displacement between the cup and the seal along the axis of said seal from a first position, in which the cup receives and covers the sealing lip in the radially inwardly compressed state, to a second position, in which the cup is axially spaced from the sealing lip allowing the latter to expand into engagement with said associated wellhead casing.

11. Apparatus of claim 10, wherein the normally upper end of the main tube is provided with a valve adapted to selectively close or open the main tube, said valve being releasably secured to an outer housing of a hydraulically extensible or contractible telescopic arrangement adapted to overlap in extended state virtually the entire length of the main tube; said housing including union means for securement of a normally lower face of the housing to a normally upper end of the wellhead casing of the respective services well such that, on extension of said telescopic means, the seal protective cup is disposed exteriorly beyond the union means at a close spacing therefrom.

12. Apparatus according to claim 11, wherein the relative displacement between the cup and the seal, from the first position to the second position is in said first axial direction, whereby the movement of the lip relative to the cup is in the direction of convergence of said skirt.

13. Apparatus according to claim 12, wherein the cup defines an annular chamber the size and shape of which is complementary with the seal for virtually entirely surrounding the seal in an inwardly compressed state within said annular chamber such that the seal is protected by said cup both at a peripheral portion thereof and at a forward face complementary with the lip.

14. Apparatus as claimed in claim 13, wherein the cup is fixedly secured to the seal tube and wherein the seal is slidable along an outer surface of the seal tube, to bring the lip out of said cup to release the lip into its operative position.

15. Apparatus as claimed in claim 14, wherein the seal includes a root section which is axially opposite to the lip and is surrounded by a seal holding sleeve surrounding the root section and pressing same against the exterior of the seal tube to maintain a sealing engagement between the exterior and the root section.

16. Apparatus as claimed in claim 15, wherein said seal further includes a second, inwardly directed skirt portion combining with the first skirt like portion to form a generally Vshaped groove divergent and open in said first axial direction.

17. Apparatus as claimed in claim 13, wherein said displacement means includes passage means in said cup directed to communicate said annular chamber with a leading end of the apparatus, whereby pressure generated exteriorly of the servicing tool can be communicated to the annular chamber to cause said axial displacement between the seal and the chamber.

18. Apparatus as claimed in claim 17, wherein the cup has a generally cylindrical outside portion whose diameter is smaller than the inside diameter of the respective wellhead casing but is sufficiently large to provide a smaller cross-sectional area of a clearance between the cup and the associated wellhead casing than that of said passage means.

19. Apparatus as claimed in claim 18, wherein the generally cylindrical outside portion is provided with a seal complementary with the respective wellhead casing, whereby said clearance is reduced to a minimum.

20. Apparatus as claimed in claim 6, wherien said displacement means includes passage means in said cup directed to communicate said annular chamber with a leading end of the apparatus, whereby pressure generated exteriorly of the servicing tool can be communicated to the annular chamber to cause said axial displacement between teh seal and the chamber.

21. Apparatus as claimed in claim 16, wherein said displacement means includes passage means in said cup directed to communicate said annular chamber with a leading end of the apparatus, whereby pressure generated exteriorly of hte servicing tool can be communicated to the annular chamber to cause said axial displacement between the seal and the chamber.

* * * * *